United States Patent [19]

Morel

[11] 4,037,489

[45] July 26, 1977

[54] MECHANICAL DEVICES AND MEANS FOR ROTATING A SHAFT

[75] Inventor: Henri Morel, Maule, France

[73] Assignee: ITW de France, S.A., Beauchamp, France

[21] Appl. No.: 716,050

[22] Filed: Aug. 20, 1976

[30] Foreign Application Priority Data

Aug. 29, 1975 France ..... 75.26673

[51] Int. Cl.[2] ..... G05G 1/00

[52] U.S. Cl. ..... 74/548; 74/545

[58] Field of Search ..... 74/543, 548, 545; 251/291

[56] References Cited

U.S. PATENT DOCUMENTS

| | | | |
|---|---|---|---|
| 1,878,569 | 9/1932 | Zolleis | 74/548 |
| 2,496,700 | 2/1950 | Cole | 74/543 |
| 3,189,069 | 6/1965 | Stowell | 74/543 UX |
| 3,503,586 | 3/1970 | Bordes | 251/291 X |

*Primary Examiner*—Alan Cohan

*Attorney, Agent, or Firm*—Jack R. Halvorsen; Robert W. Beart

[57] ABSTRACT

A mechanical assembly for rotating an axle comprises means for actuating said axle and means for fixing said actuating means together in which the axle comprises an end adapted to receive said actuating means. On this end, are at least one flat and at least one groove extending over a circular arc situated at right angles with respect to the flat. The actuating means is constituted by a knob or crankhead including a central recess adapted to receive said axle end and at least two flexible parts mounted in the recess and arranged at right angles to one another. One of these parts is adapted to bear on said flat and the other provided with a pin adapted to be engaged in said groove. The fixing means is constituted by a ring adapted to encircle and grip the two parts of the actuating means respectively against and in the flat and the groove of the axle end. The ring comprises means adapted to render it itself fast to the actuating means.

3 Claims, 10 Drawing Figures

MECHANICAL DEVICES AND MEANS FOR ROTATING A SHAFT

BACKGROUND OF THE INVENTION

1. Field of the Invention

The present invention relates to devices and mechanical means for rotating an axle, shaft or spindle. It relates more particularly to knobs and crank handles for actuating axles and to devices for mounting and fixing them on these axles.

2. Description of the Prior Art

It is known that, for this purpose, axles generally of circular cross-section, have at their end for receiving the knob or the crank handle, one or two flats, or a polygonal cross-section cooperating with corresponding one or two flats or polygonal section provided on the knob or the crank handle. Furthermore, to render these elements fast to one another, recourse is had to a fixing and tightening screw, cooperating or not, as the case may be, with a tapped hole provided on the axle, which screw must unavoidably be turned by means of a screwdriver before and after the assembly or mounting of the elements. Moreover, in the case of the existence of a hole tapped at the shaft end, this mounting and this fixing are effected by manipulating the parts so that the screw is presented exactly facing this hole and so that the straightness of this positioning is ensured and preserved in the course of tightening.

OBJECTS AND GENERAL DESCRIPTION OF THE INVENTION

It is an object of the present invention to provide an assembly (axle, actuating means and means for fastening these two elements - hereinafter called fixing or locking means) which is simple to produce and does not necessitate special intervention in the course of mounting nor a special tool for fixing or locking.

The assembly according to the invention (axle, actuating means, fixing means) is essentially characterised by the fact that the end of the axle intended to receive the actuating means comprises at least one flat and at least one groove extending over a circular arc orthogonal to said flat, that the actuating means constituted by a knob or a crank handle head comprises a central recess for the housing of said axle end and at least two parts endowed with elasticity mounted in said recess and arranged orthogonally to one another, one of these parts being intended to bear on said flat and the other, provided with a pin intended to engage in said groove and that the fixing or locking means is essentially constituted by a ring intended to grip around said parts of the actuating means against and into the corresponding elements of the axle, said ring comprising preferably means to render it fast itself to said actuating means.

According to other features of the invention:

the end of the axle intended to receive the actuating means comprises two flats and a circular groove extending over the whole periphery of this axle and the actuating means comprises two pairs of parts endowed with elasticity, namely one pair of parts diametrically opposite and parallel to one another each intended to bear on one of the two flats of the axle and a pair of parts orthogonal to the first pair and intended to be engaged, by their pin, in said circular groove;

the fixing or locking ring is provided with a flange comprising means rendering it fast to the actuating means the fastening of the fixing or locking ring is advantageously ensured by a spring catch.

BRIEF DESCRIPTION OF THE DRAWINGS

Other features and advantages of the assembly according to the invention will emerge more clearly from the description which follows, with reference to the accompanying drawings, in which.

DESCRIPTION OF PREFERRED EMBODIMENTS

Figure 4A:
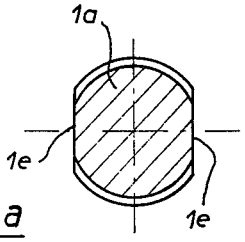
FIG. 4*a* is a sectional view along the line IV—IV of FIG. 4.
Figure 4:
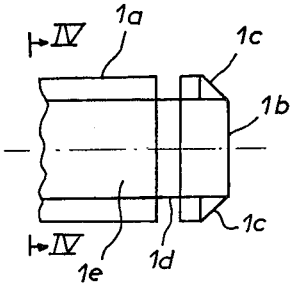
FIG. 4 is a view in elevation of an axle end according to the invention.

Referring to the drawings, there is shown in FIGS. 4 – 4*a* a stub shaft 1*a* whose end 1*b* is bevelled 1*c* to facilitate the mounting of an actuating knob or the head of a crank handle such as described below. A groove 1*d* is machined in the vicinity of this end. This axle end comprises in addition, in the embodiment illustrated, two flats 1*e*.

Figure 3:
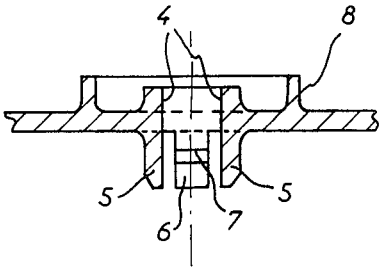
FIG. 3 is a sectional view along the line II—II of FIG. 1.
Figure 2:
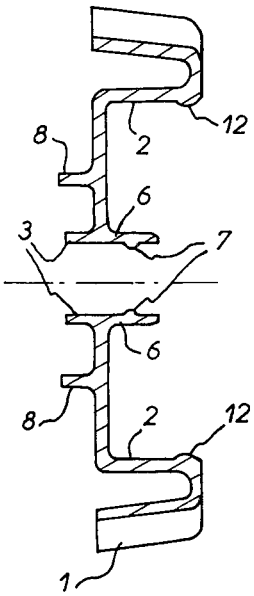
FIG. 2 is a sectional view along the line I—I of FIG. 1.
Figure 1:
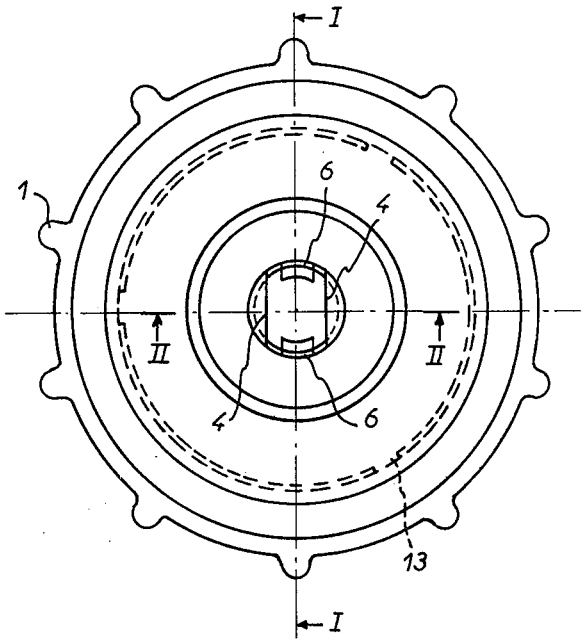
FIG. 1 is a plan view of one embodiment of an axle actuating knob according to the invention.

Referring now to FIGS. 1 to 3, the actuating knob 1 which is shown by way of illustration, comprises a recess 2 formed in the body of the constituent material of this knob and a central orifice 3. The latter comprises two flats 4 extending inwardly of the recess 2 through two parts endowed with elasticity 5 and whose surfaces occurring on the side of the interior of the central orifice are preferably flat, their separation, like that of the remainder of the two flats 4 corresponding substantially to the distance between the two flats 1*e* of the shaft or axle 1*a*. In addition, two other parts endowed with elasticity 6 are arranged at right-angles with respect to the two parts 5. The thickness of the parts thus constructed is such that their outer surfaces define a single cylinder. These two parts 6 each comprise a pin or stub 7 calculated so that it can spring catch into the groove of the shaft end 1*d*.

The whole or a fraction of the periphery of the recess 2 comprises a boss 12 whose purpose will become apparent from the description below.

In addition, there may advantageously be provided a circular ring or crown 8 overlapping with respect to the central orifice comprising the flats to serve as a stop or to ensure protection of the drive elements.

Figure 5:
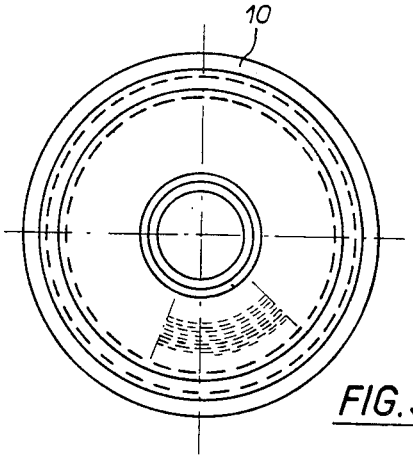
FIG. 5 is a plan view of a locking part according to the invention.
Figure 6:
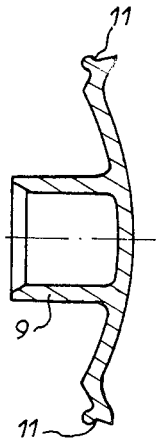
FIG. 6 is a profile view of the part illustrated in FIG. 5.

In addition, the assembly according to the invention comprises a locking part of which one embodiment is illustrated in FIGS. 5 and 6. This part is designed to be positioned in the recess 2. It comprises a central portion 9 or central ring of internal diameter substantially equal to to the external diameter of the cylinder bounded by the four independent parts 5 and 6 of the actuating knob. It is thus designed to cap and grip the parts 5 and 6, as will be seen below. The outer diameter of this central ring is calculated so that complete locking is ensured due to sufficient rigidity. The external shape of the flange 10 capping this central ring is adapted to the recess 2 and comprises a pin or stub 11 intended to cooperate with the boss 12 of the recess of the actuating knob by means of a certain flexibility of the constituent material of this flange.

Additionally, recesses 13 are provided, either at the periphery of the recess 2 of the actuating knob, or at the periphery of the part 10 (recesses not shown in the drawing). The purpose of these recesses in unlocking will become apparent from the description below.

The mounting of the assembly described above is effected in the following manner:

The actuating knob is engaged on the end of the axle 1*a* through the central orifice 3. Engagement is facilitated by the bevel of the axle 1*c*. The actuating knob is pushed until the pins 7 of the elastic parts 6 become caught in the groove 1*d* of the end of the axle. The two parts with flats 5 have at the same time slid over the two flats 1*e* of the axle. The locking part is engaged: the central ring 9 (slightly bevelled to facilitate insertion) comes to imprison the four tongues or scales 5 and 6 due to the fact that the outer diameter bounded by these parts is the same as the inner diameter of this ring. Through this fact, locking is ensured and any risk of play eliminated since the four parts 5 and 6 are entirely imprisoned by force. The fastening of the parts is effected by spring engagement (after slight elastic deformation of the flange 10) of the boss 12 and of the pin 11, by simple pressure.

The assembly is thus perfectly locked and the driving of the shaft ensured by the actuating knob. In addition, the flange 10 improves the appearance of the assembly by masking from view the device according to the invention.

For dismounting it suffices to introduce any tool (a screwdriver for example) into one of the recesses 13 to unfasten the flange 10 by disengaging the elements 11 and 12 by lever action. A small central hole (not shown) of small diameter would also be sufficient to ensure the dismounting of the locking part by a simple hook tool. It then suffices to withdraw the actuating knob from the axle by taking advantage of the elasticity of the tongues 6 to disengage the pins 7 from the groove 1*d* of the end of the axle.

Figure 7:
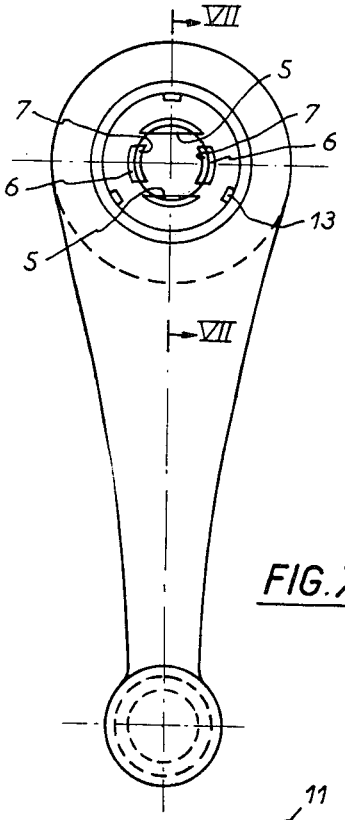
FIG. 7 is a plan view of an embodiment of an actuating crank handle according to the invention.
Figure 8:
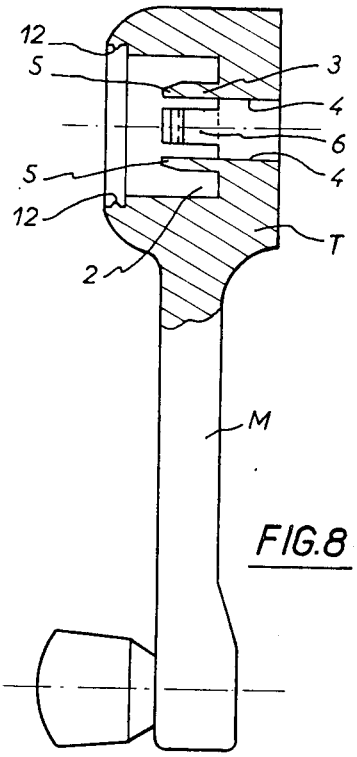
FIG. 8 is a profile view of the crank handle illustrated in FIG. 7, with partial section along the line VII—VII of this Figure.

Referring to FIGS. 7 and 8, there is illustrated a head T of a crank handle M provided with a device according to the invention.

In these drawings, the reference numerals used are the same as those used previously when they denoted the same parts or parts with an equivalent function.

Thus the central portion 3 is to be found in a recess 2; it comprises two flats 4 which correspond to the two flats 1*e* of the end of the driven shaft. Due to the presence of the recess 2, the two flats 4 become two elastic tongues which become adapted to the end of the axle 1*a*. At right angles to these two elastic tongues 5, are mounted two other elastic tongues 6 each comprising a pin 7 calculated to become spring-engaged in the groove 1*d* of the axle 1*a*.

Figure 9:
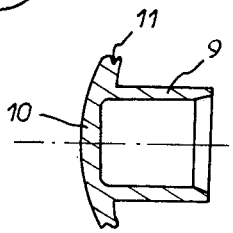
FIG. 9 is a view in sectional elevation of another embodiment of a locking part according to the invention.

The locking part (shown in FIG. 9) is positioned as in the case of the previously described control knob, in the recess 2 of the head of the crank handle to ensure the locking and to improve the appearance of the assembly.

It comprises a ring 9 of the same inner diameter as the outer diameter of the cylinder bounded by the four independent tongues 5 and 6. The outer shape of the flange 10 is adapted to the recess 2 and comprises a shoulder 11 designed to come into cooperation with a boss 12 provided at the periphery of the recess 2.

For dismounting, as previously, there are provided recesses 11, either at the periphery of the recess 2, or at the periphery of the locking part. These recesses enable the insertion of any tool to obtain the unfastening of the parts.

The mounting and dismounting of the assembly which has just been described is effected as in the case of the actuating knob.

It is self-evident that the present invention has only been described and illustrated by way of preferential example and that it will be possible to introduce any useful modification therein, in the way of equivalents, without however departing from the scope of the invention as defined by the appended claims.

Thus the knob and the crank handle head could comprise one part cooperating with a single flat provided on the end of the axle to be driven and one part preferably at right angles cooperating with a groove of said axle. In addition the means for fastening the flange of the locking part and the actuating part could be of any type.

I claim:

1. Mechanical assembly for driving an axle in rotation comprising means for actuating said axle and means for fixing said actuating means together, wherein said axle comprises an end adapted to receive said actuating means, with, on said end, at least one flat and at least one groove extending over a circular arc situated at right angles with respect to said flat, said actuating means is constituted by a knob or crank-handle head including a central recess adapted to receive said axle end and at least two flexible parts mounted in said recess and arranged at right angles to one another, one of these parts being adapted to bear on said flat and the other provided with a pin adapted to be engaged in said groove and said fixing means is constituted by a ring adapted to encircle and grip said two parts of said actuating means respectively against and in said flat and said groove of said axle end, said ring comprising means adapted to make it itself fast to said actuating means.

2. Mechanical assembly according to claim 1, in which the axle end designed to receive the actuating means comprises two flats and a circular groove extending over the whole periphery of this axle and the actuating means comprises two pairs of parts endowed with elasticity, namely a pair of parts diametrically opposite and parallel to one another, each designed to bear on one of the two flats of the axle and a pair of parts orthogonal to the first pair and designed to be engaged, by their pin, in said circular groove.

3. Assembly according to claim 1, in which said fixing ring comprises a flange provided with catch means adapted to make it fast to said actuating means.

* * * * *